US010256521B2

(12) United States Patent
Elsherbini et al.

(10) Patent No.: US 10,256,521 B2
(45) Date of Patent: Apr. 9, 2019

(54) WAVEGUIDE CONNECTOR WITH SLOT LAUNCHER

(71) Applicant: Intel Corporation, Santa Clara, CA (US)

(72) Inventors: Adel A. Elsherbini, Chandler, AZ (US); Sasha N. Oster, Chandler, AZ (US); Johanna M. Swan, Scottsdale, AZ (US); Georgios C. Dogiamis, Chandler, AZ (US); Shawna M. Liff, Scottsdale, AZ (US); Aleksandar Aleksov, Chandler, AZ (US); Telesphor Kamgaing, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 197 days.

(21) Appl. No.: 15/280,823

(22) Filed: Sep. 29, 2016

(65) Prior Publication Data

US 2018/0090803 A1 Mar. 29, 2018

(51) Int. Cl.
*H01P 5/10* (2006.01)
*H01P 11/00* (2006.01)
*H01P 5/107* (2006.01)

(52) U.S. Cl.
CPC ..... *H01P 5/1007* (2013.01); *H01P 11/00* (2013.01); *H01P 5/107* (2013.01)

(58) Field of Classification Search
CPC .... H01P 5/08; H01P 5/10; H01P 5/107; H01P 5/1007; H01P 5/1015; H01P 11/00
USPC ..... 333/24 R
See application file for complete search history.

(56) References Cited

U.S. PATENT DOCUMENTS

| | | | |
|---|---|---|---|
| 4,853,704 | A | 8/1989 | Diaz et al. |
| 4,882,553 | A | 11/1989 | Davies et al. |
| 5,036,335 | A | 7/1991 | Jairam |
| 5,545,924 | A | 8/1996 | Contolatis et al. |
| 5,557,291 | A | 9/1996 | Chu et al. |

(Continued)

FOREIGN PATENT DOCUMENTS

| | | | |
|---|---|---|---|
| EP | 0257881 | A2 | 3/1998 |
| JP | 2007235563 | A | 9/2007 |

OTHER PUBLICATIONS

Unpublished—PCT Application No. PCT/US2016/054900, filed Sep. 30, 2016.

(Continued)

*Primary Examiner* — Rakesh B Patel
*Assistant Examiner* — Jorge L Salazar, Jr.
(74) *Attorney, Agent, or Firm* — Grossman, Tucker, Perreault & Pfleger, PLLC

(57) ABSTRACT

The systems and methods described herein provide a traveling wave launcher system physically and communicably coupled to a semiconductor package and to a waveguide. The traveling wave launcher system includes a slot-line signal converter and a tapered slot launcher. The slot-line signal converter may be formed integral with the semiconductor package and includes a balun structure that converts the microstrip signal to a slot-line signal. The tapered slot launcher is communicably coupled to the slot-line signal converter and includes a first plate and a second plate that form a slot. The tapered slot launcher converts the slot-line signal to a traveling wave signal that is propagated to the waveguide.

25 Claims, 10 Drawing Sheets

(56) References Cited

U.S. PATENT DOCUMENTS

| | | | |
|---|---|---|---|
| 6,292,153 | B1 | 9/2001 | Aiello et al. |
| 6,317,094 | B1 | 11/2001 | Wu et al. |
| 7,057,570 | B2 | 6/2006 | Irion, II |
| 7,471,165 | B2 | 12/2008 | Asamura et al. |
| 9,142,889 | B2 | 9/2015 | Pazin et al. |
| 2002/0186105 | A1 | 12/2002 | Shih et al. |
| 2003/0137465 | A1 | 7/2003 | Graczyk et al. |
| 2003/0169965 | A1 | 9/2003 | Hanada |
| 2003/0197572 | A1 | 10/2003 | Ammar |
| 2005/0012199 | A1 | 1/2005 | Rosenau et al. |
| 2005/0012672 | A1 | 1/2005 | Fisher |
| 2007/0031083 | A1 | 2/2007 | Logvin et al. |
| 2008/0211726 | A1 | 9/2008 | Elsallal et al. |
| 2008/0224936 | A1 | 9/2008 | Brist et al. |
| 2010/0053026 | A1 | 3/2010 | Van Der Poel |
| 2010/0302544 | A1 | 12/2010 | Duer |
| 2011/0018657 | A1 | 1/2011 | Cheng et al. |
| 2011/0102284 | A1 | 5/2011 | Braown et al. |
| 2011/0267249 | A1 | 11/2011 | Miyata |
| 2012/0176285 | A1 | 7/2012 | Morgia |
| 2013/0082800 | A1 | 4/2013 | Rofougaran et al. |
| 2013/0120206 | A1 | 5/2013 | Biancotto et al. |
| 2014/0085156 | A1 | 3/2014 | Gebretnsae et al. |
| 2014/0218251 | A1 | 8/2014 | Waschenko et al. |
| 2014/0291835 | A1 | 10/2014 | Demin et al. |
| 2015/0029069 | A1 | 1/2015 | Roemer et al. |
| 2015/0048471 | A1 | 2/2015 | Hasch et al. |
| 2015/0260916 | A1 | 9/2015 | Cherchi et al. |
| 2016/0043455 | A1 | 2/2016 | Seler et al. |
| 2016/0153040 | A1 | 6/2016 | Zhong et al. |
| 2017/0324135 | A1* | 11/2017 | Blech ..... H01P 5/107 |
| 2018/0090803 | A1 | 3/2018 | Elsherbini et al. |

OTHER PUBLICATIONS

Unpublished U.S. Appl. No. 15/277,504, filed Sep. 27, 2016.
Unpublished—PCT Application No. PCT/US2016/053491, filed Sep. 23, 2016.
Unpublished—PCT Application No. PCT/US2016/053463, filed Sep. 23, 2016.
Unpublished—PCT Application No. PCT/US2016/054417, filed Sep. 29, 2016.
Unpublished—PCT Application No. PCT/US2016/054977, filed Sep. 30, 2016.
Unpublished—PCT Application No. PCT/US2016/054832, filed Sep. 30, 2016.
Unpublished—PCT Application No. PCT/US2016/054888, filed Sep. 30, 2016.
Unpublished—PCT Application No. PCT/US2016/054837, filed Sep. 30, 2016.
Unpublished U.S. Appl. No. 15/282,050, filed Sep. 30, 2016.
Unpublished U.S. Appl. No. 15/282,086, filed Sep. 30, 2016.
International Search Report and Written Opinion issued in PCT/US2017/049173, dated Dec. 11, 2017, 13 pages.
International Search Report and Written Opinion issued in PCT/US2017/048755, dated Dec. 14, 2017, 10 pages.
International Search Report received for PCT Application No. PCT/US2016/053491, dated Apr. 25, 2017, 10 pages.
International Search Report received for PCT Application No. PCT/US2016/054417, dated Jun. 20, 2017, 9 pages.
International Search Report received for PCT Application No. PCT/US2016/054900, dated Apr. 25, 2017, 12 pages.
International Search Report received for PCT Application No. PCT/US2016/053463, dated Apr. 25, 2017, 12 pages.
Office Action received in U.S. Appl. No. 15/277,504, dated Sep. 10, 2018, 19 pages.

* cited by examiner

WAVEGUIDE CONNECTOR WITH SLOT LAUNCHER

TECHNICAL FIELD

The present disclosure relates to semiconductor package slot launchers used with microwave waveguides.

BACKGROUND

As more devices become interconnected and users consume more data, the demand placed on servers accessed by users has grown commensurately and shows no signs of letting up in the near future. Among others, these demands include increased data transfer rates, switching architectures that require longer interconnects, and extremely cost and power competitive solutions.

There are many interconnects within server and high performance computing (HPC) architectures today. These interconnects include within blade interconnects, within rack interconnects, and rack-to-rack or rack-to-switch interconnects. In today's architectures, short interconnects (for example, within rack interconnects and some rack-to-rack) interconnects are achieved with electrical cables—such as Ethernet cables, co-axial cables, or twin-axial cables, depending on the required data rate. For longer distances, optical solutions are employed due to the very long reach and high bandwidth enabled by fiber optic solutions. However, as new architectures emerge, such as 100 Gigabit Ethernet, traditional electrical connections are becoming increasingly expensive and power hungry to support the required data rates. For example, to extend the reach of a cable or the given bandwidth on a cable, higher quality cables may need to be used or advanced equalization, modulation, and/or data correction techniques employed which add power and latency to the system. For some distances and data rates required in proposed architectures, there is no viable electrical solution today. Optical transmission over fiber is capable of supporting the required data rates and distances, but at a severe power and cost penalty, especially for short to medium distances, such as a few meters.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1:
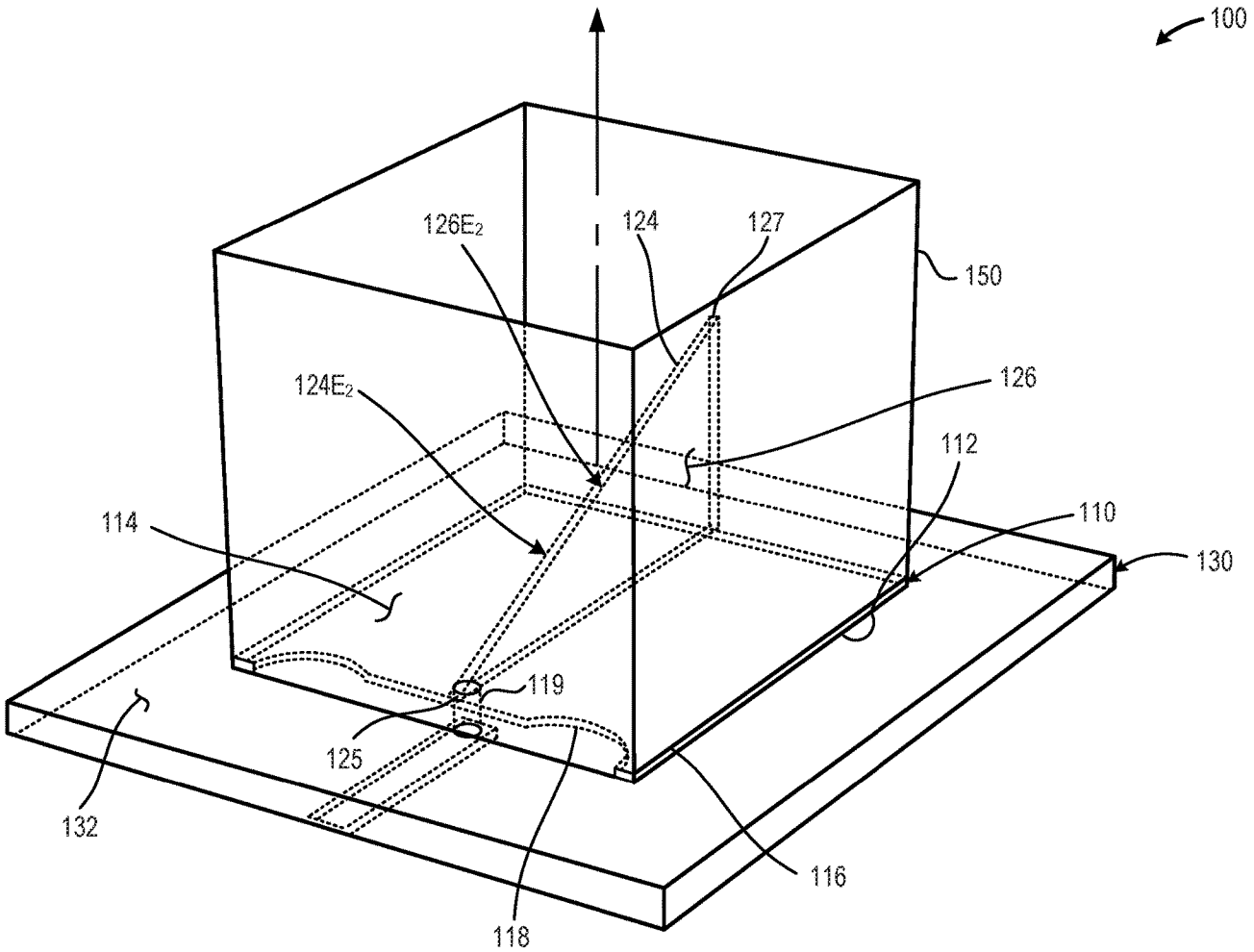
FIG. 1 provides a perspective view of an illustrative traveling wave launcher system that includes a slot-line signal converter that includes a tapered slot launcher disposed proximate an external surface of a semiconductor package and a proximate a waveguide, in accordance with at least one embodiment described herein.

Although the following Detailed Description will proceed with reference being made to illustrative embodiments, many alternatives, modifications and variations thereof will be apparent to those skilled in the art.

DETAILED DESCRIPTION

As data transfer speeds continue to increase, cost efficient and power competitive solutions are needed for communication between blades installed in a rack and between nearby racks. Such distances typically range from less than 1 meter to about 10 meters. The systems and methods disclosed herein use millimeter-wave transceivers paired with waveguides to communicate data between blades and/or racks at transfer rates in excess of 25 gigabits per second (Gbps). The millimeter wave signal launchers used to transfer data may be formed and/or positioned in, on, or about the semiconductor package. A significant challenge exists in aligning the millimeter-wave launcher with the waveguide member to maximize the energy transfer from the millimeter-wave antenna to the waveguide member. Further difficulties may arise when one realizes the wide variety of available waveguide members. Although metallic and metal coated waveguide members are prevalent, such waveguide members may include rectangular, circular, polygonal, oval, and other shapes. Such waveguide members may include hollow members, members having a conductive and/or non-conductive internal structure, and hollow members partially or completely filled with a dielectric material.

Coupling a waveguide member to a semiconductor package in a location that maximizes the energy transfer between the millimeter-wave launcher and the waveguide member. Such positioning is complicated by the shape of the waveguide member, the relatively small dimensions associated with the waveguide member (e.g., 5 millimeters or less), the relatively tight tolerances required to maximize energy transfer (e.g., 10 micrometers or less), and a millimeter-wave launcher that is potentially hidden beneath the surface of the semiconductor package. The systems and methods described herein provide new, novel, and innovative systems and methods for positioning and coupling waveguide members to semiconductor packages such that energy transfer from the millimeter-wave launcher to the waveguide member is maximized.

The system and methods disclosed herein employ new launcher and waveguide connector architecture for exciting waveguides coupled to a semiconductor package. Semiconductor package mounted launchers include a patch or stacked patch structure that is electrically connected to the waveguide walls. Such "patch" or "stacked patch" installations suffer from limited bandwidth for thin semiconductor package substrates, and consequently employ the use of relatively thick semiconductor package substrates. Such thick semiconductor package substrates may cause manufacturing and assembly limitations. In addition, such waveguide/semiconductor package patch systems are sensitive to waveguide alignment and conductive coupling to the signal generator in the semiconductor package.

The systems and methods described herein employ a different type of excitation structure, a tapered slot launcher that is compatible with and may be incorporated into conventional printed circuit board manufacturing processes. Such tapered slot launchers beneficially provide an inherently wide transmission band and are advantageously less sensitive to manufacturing tolerances. Compared to patch or stacked patch launchers, the systems and methods described herein beneficially provide increased bandwidth in a thinner semiconductor package. Additionally, the energy efficiency of the traveling wave tapered slot launcher is significantly improved over resonant wave launchers such as patch or stacked patch launchers. Compared to tapered launchers integrated into a semiconductor package, the systems and methods described herein allow for perpendicularly mounting the waveguides to the semiconductor package, thus beneficially supporting the use of multidimensional (2-D) arrays.

In embodiments, the systems and methods herein convert a signal transmitted along a microstrip to a slot-line mode using a balun structure disposed proximate an external surface of a semiconductor package. The balun structure may include a double-lobed balun structure. The slot-line mode signal is translated to a direction perpendicular to the semiconductor package and propagates through a tapered slot which converts the signal to a closed waveguide mode. Beneficially, the systems and methods described herein may be adapted to dielectric waveguides through the use of 180 degree opposed slot launchers and may also be adapted to various waveguide geometries by adjusting the shape of the outline on the semiconductor package to match the geometry of the waveguide.

A traveling wave launcher apparatus is provided. The apparatus may include a slot-line signal converter that includes: a first electrically conductive member having a first physical geometry, the first electrically conductive member conductively coupleable to a semiconductor package; and a second electrically conductive member having a second physical geometry; the second electrically conductive member conductively coupleable to the first electrically conductive member and conductively coupleable to a waveguide member. The apparatus may further include a tapered slot launcher that includes a first plate and a second plate; wherein the tapered slot launcher includes at least a first end and a second end, the first end of the tapered slot launcher physically closer to the second surface than the second end; wherein the tapered slot launcher communicably couples to the second electrically conductive member; and wherein the first plate and the second plate extend at an angle from the second electrically conductive member.

A traveling wave transmission method is provided. The method may include providing a signal to a slot-line signal converter communicably coupled to a semiconductor package and physically coupled to a surface of the semiconductor package; converting the signal to a slot line signal via the slot-line signal converter; and converting the slot line signal to a closed waveguide mode signal via a tapered slot launcher that includes a first plate and a second plate, the first plate and the second plate disposed normal to the surface of the semiconductor package.

A traveling wave transmission system is provided. The system may include a means for providing a signal to a slot-line signal converter communicably coupled to a semiconductor package and physically coupled to a surface of the semiconductor package; a means for converting the signal to a slot line signal, via the slot-line signal converter; and a means for converting the slot line signal to a closed waveguide mode signal via a tapered slot launcher that includes a first plate and a second plate, the first plate and the second plate disposed normal to the surface of the semiconductor package.

A mm-Wave transmission system is provided. The system may include a semiconductor package. The semiconductor package may include a mm-wave die; and a first electrically conductive member having a first physical geometry, the first electrically conductive member disposed on at least a portion of an exposed surface of the semiconductor package and conductively coupled to the mm-wave die; a waveguide defining an interior space; and a traveling wave microwave launcher communicably coupling the semiconductor package and the waveguide member. The traveling wave microwave launcher may include a slot-line signal converter that includes: a second electrically conductive member having a first surface, a second surface, and a second physical geometry; the first surface conductively coupleable to the first electrically conductive member and the second surface conductively coupleable to the waveguide; and a tapered slot launcher that includes a first plate and a second plate, the tapered slot launcher at least partially extending into the interior space of the waveguide; wherein the tapered slot launcher includes at least a first end and a second end, the first end of the tapered slot launcher physically closer to the second surface than the second end; wherein the tapered slot launcher communicably couples to the second electrically conductive member; and wherein the first plate and the second plate extend at an angle from the second electrically conductive member.

FIG. 1 provides a perspective view of an illustrative traveling wave launcher system 100 that includes a slot-line signal converter 110 that includes a tapered slot launcher 120 disposed proximate an external surface of a semiconductor package 130 and a proximate a waveguide 150, in accordance with at least one embodiment described herein. The tapered slot launcher 120 includes a tapered slot 122 formed between a first plate 124 spaced apart from a second plate 126. In some implementations, the first plate and the second plate may include all or a portion of different, opposed, sides of a single member. The slot-line signal converter 110 includes a first electrically conductive member 112 disposed proximate an external surface of the semiconductor package 130 and a second electrically conductive member 114 which physically and conductively couples to the tapered slot launcher 120. The slot-line signal converter 110 may include a balun structure 118 that converts a signal supplied via a microstrip line or a coplanar waveguide from a mm-wave die to a slot-line signal that is transmitted by the tapered slot launcher 120.

The slot-line signal converter 110 converts the microstrip signal supplied by a mm-wave die to a slot-line signal. The microstrip signal may, in some implementations, be generated or otherwise created and supplied to the microstrip to slot-line signal converter 110 by one or more components such as a mm-wave die disposed in or communicably coupled to the semiconductor package 130. The microstrip signal operates at a microwave frequency of from about 30 GHz to about 300 GHz; about 30 GHz to about 200 GHz; or about 30 GHz to 100 GHz. Other signal frequencies may be used to equal effect.

The slot-line signal converter 110 includes a first electrically conductive member 112 disposed proximate at least a portion of an external surface 132 of the semiconductor package 130 and a second electrically conductive member 114 disposed proximate the tapered slot launcher 120. In embodiments, the first electrically conductive member 112 and the second electrically conductive member 114 may include two different electrically conductive members that are physically and/or conductively coupled 116 using solder, an electrically conductive adhesive, or similar. In other embodiments (not depicted in FIG. 1), the first electrically conductive member 112 and the second electrically conductive member 114 may include opposite sides of a single, electrically conductive, member.

The first electrically conductive member 112 and the second electrically conductive member 114 may have any shape, size, or configuration. For example, the first electrically conductive member 112 and the second electrically conductive member 114 may have a shape based at least in part on the cross-sectional shape of the waveguide 150. Thus, for example, the first electrically conductive member 112 and the second electrically conductive member 114 may be circular shaped for a waveguide 150 having a circular cross-section, elliptical shaped for a waveguide 150 having an elliptical cross-section.

In embodiments, the first electrically conductive member 112 may be formed, patterned, or otherwise disposed on the external surface 132 of the semiconductor package 130. In other embodiments, the first electrically conductive member 112 may be conductively and/or physically coupled to one or more electrical contacts (e.g., vias, pads, lands, or similar electrically conductive structures) disposed on an external surface 132 of the semiconductor package 130. In such embodiments, the first electrically conductive member 112 may be physically and conductively coupled to one or more electrical contacts via solder, an electrically conductive adhesive, or similar electrically conductive bonding or affixation systems and methods.

In embodiments, the second electrically conductive member 114 may be formed integrally with all or a portion of the tapered slot launcher 120. In other embodiments, the second electrically conductive member 114 may be formed separate from the tapered slot launcher 120 and the tapered slot launcher 120 may be physically and/or conductively coupled to the second electrically conductive member 114. In yet other embodiments, all or a portion of the second electrically conductive member 114 may be formed integral with the waveguide 150. Forming the tapered slot launcher 120 integral with the second electrically conductive member 114 beneficially aligns the tapered slot launcher 120 with the second electrically conductive member 114 and, consequently, with the waveguide 150 when the waveguide 150 is conductively coupled to the second electrically conductive member 114.

The slot-line signal converter 110 converts the received microstrip signal to a slot-line mode signal (i.e., two impedance matched signals) using the balun structure 118. The balun structure 118 may include a double-lobed or barbell type balun structure 118 such as that depicted in FIG. 1. The microstrip signal is fed to the balun structure 118 receives the input microstrip signal at a central location on the structure, such as a connection point 119. The open spaces in the balun structure 118 provide an impedance matched slot line signal that is communicated to the communicably coupled slot-line signal converter 110. In implementations, where the slot-line signal converter 110 includes a single member that provides the first electrically conductive member 112 and the second electrically conductive member 114, the balun structure 118 may be symmetric across the slot-line signal converter 110 (i.e., the physical configuration of the balun structure 118 on the first electrically conductive member 112 and the second electrically conductive member 114 will be identical). In implementations where the slot-line signal converter 110 includes separate first electrically conductive member 112 and second electrically conductive member 114, the balun structure 118 may be asymmetric across the slot-line signal converter 110 (i.e., the physical configuration of the balun structure 118 on the first electrically conductive member 112 and the second electrically conductive member 114 may be different).

The balun structure 118 may include a double lobed structure having symmetric or asymmetric lobes with any physical configuration. Thus, the lobes forming the balun structure 118 may be semi-circular, circular, semi-elliptical, elliptical, semi-polygonal, polygonal, etc. The physical dimensions and/or configuration of the lobes forming the balun structure 118 may be based in whole or in part on the operating frequency and/or frequency range of the microstrip signal supplied to the microstrip to slot-line signal converter 110.

The tapered slot launcher 120 transitions the axis of propagation of the slot-line mode signal provided by the balun structure 119 to different axis of propagation 128 and converts the signal to a closed waveguide mode signal (e.g., a TE10 for a waveguide 150 having a rectangular cross-section). In some implementations, the axis of propagation 128 of the closed waveguide mode signal may be normal to the external surface of the semiconductor package 130. In some implementations, the axis of propagation 128 of the closed waveguide mode signal may be aligned or parallel to a longitudinal axis of the waveguide 150 coupled to the traveling wave launcher system 100.

In some implementations, the tapered slot launcher 120 includes a first plate 124 and a second plate 126 that may be spaced apart or separated to form a slot 122. In some implementations, the tapered slot launcher 120 includes a first plate 124 and a second plate 126 that are opposite sides of a single, solid member—in such an embodiment, the solid "edge" of the member provides the slot 122. In embodiments, the first plate 124 and the second plate 126 may be physically and/or conductively coupled along a first edge to the second electrically conductive member 114. In such embodiments, a second edge 124$E_2$ of the first plate 124 and a second edge 126$E_2$ of the second plate 126 may extend at an angle to the second electrically conductive member 114 such that a first end 125 of the second edge is disposed closer to the second electrically conductive member 114 than a second, opposed, end 127 of the second edge. Thus, the second edge 124$E_2$ of the first plate 124 and the second edge 126$E_2$ of the second plate 126 may extend diagonally with respect to the second electrically conductive member 114. In embodiments, the first plate 124 and the second plate 126 forming the tapered slot launcher 120 are grounded to the ground plane of the semiconductor package 130 via the waveguide 150. In other embodiments, the first plate 124 and the second plate 126 forming the tapered slot launcher 120 may be coupled directly or indirectly to the ground plane of the semiconductor package 130.

In some implementations, the second edge 124$E_2$ of the second plate 124 and/or the second edge 126$E_2$ of the second plate 126 may include a straight edge, a stepped edge, a curved edge, an elliptical edge, or an arcuate edge. The distance between the first plate 124 and the second plate 126 may, in some implementations, be based in whole or in part on the frequency and/or frequency band of the closed waveguide mode signal transmitted by the tapered slot launcher 120. In other implementation, there can be a dielectric layer between the two plates for example if they are fabricated on a printed circuit board.

In some implementations, the first plate 124 and/or the second plate 126 may be formed integral with the second electrically conductive member 114 forming the slot-line signal converter 110. In such implementations, the second electrically conductive member 114 may be formed from a malleable or flexible material such as a thin metal or metal alloy layer that may be bent or otherwise permanently deformed to provide the first plate 124 and/or the second plate 126. The first plate 124 and the second plate 126 extend at an angle of from about 45° to about 90° from the second electrically conductive member 114, measured with respect to the second electrically conductive member 114. In some implementations, the overall physical dimensions of the first plate 124 and the second plate 126 may be based, in whole or in part, on the frequency or frequency band of the closed waveguide mode signal transmitted by the tapered slot launcher 120. In some implementations, the second electrically conductive member 114 and the tapered slot launcher 120 may be physically and/or communicably coupled prior to A waveguide 150 may be physically and/or communicably coupled to the slot-line signal converter 110. Upon coupling the waveguide to the slot-line signal converter 110, the tapered slot launcher 120 extends into the waveguide 150. The closed waveguide mode signal propagating from the tapered slot launcher 120 propagates along the waveguide 150. Although depicted as a rectangular waveguide in FIG. 1, the waveguide 150 may have any geometric cross section. The second electrically conductive member 114 may be physically configured to match the cross-section of the waveguide 150. Thus, for example, where the waveguide 150 has a round or oval cross-section, the second electrically conductive member 114 may have a round or oval physical configuration to match the waveguide 150. The waveguide 150 includes electrically conductive waveguides, dielectric filled conductive waveguides, dielectric waveguides, or combinations thereof.

Figure 2A:
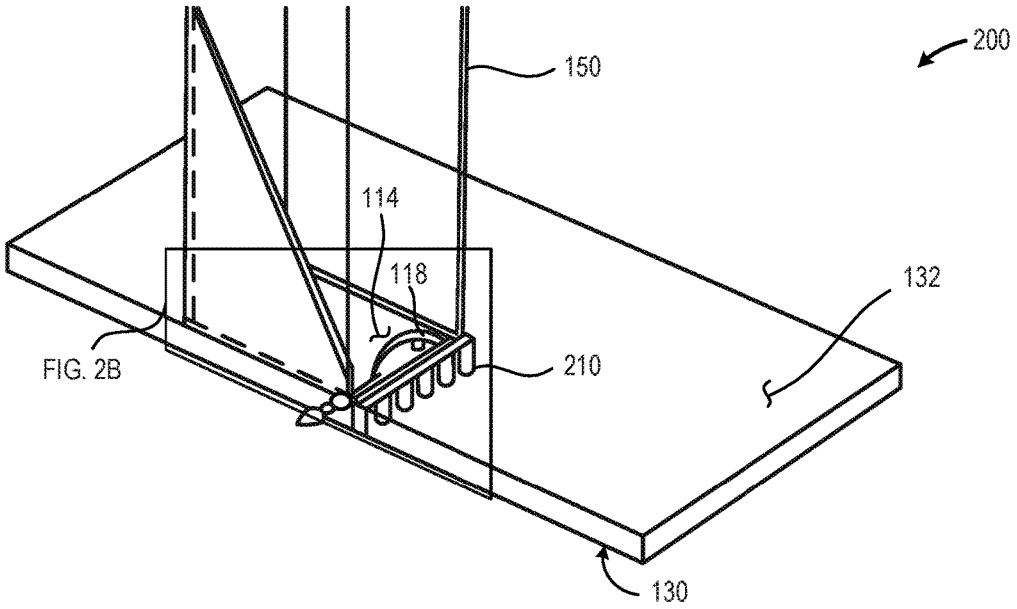
FIG. 2A provides a cut-away perspective view of an illustrative traveling wave launcher system that includes a slot-line signal converter and a tapered slot launcher, in accordance with at least one embodiment described herein.
Figure 2B:
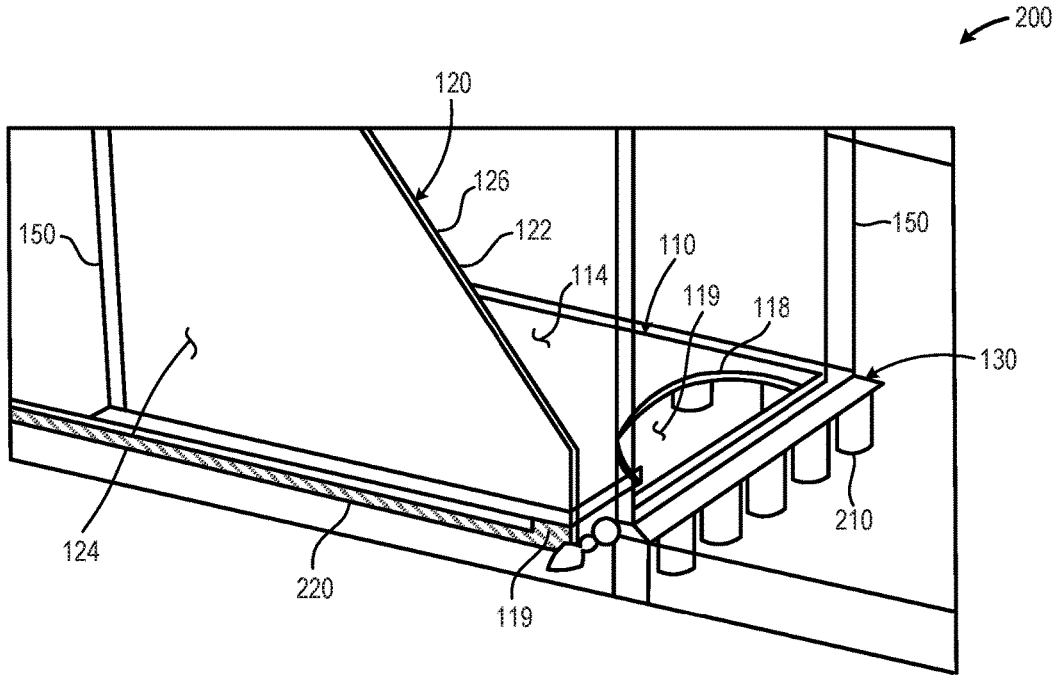
FIG. 2B provides a cut-away perspective detail view of the traveling wave launcher depicted in FIG. 2A and provides additional details showing the microstrip feed and communicable coupling between the microstrip feed and the slot-line signal converter, in accordance with at least one embodiment described herein.

FIG. 2A provides a cut-away perspective view of an illustrative traveling wave launcher system 200 that includes a slot-line signal converter 110 and a tapered slot launcher 120, in accordance with at least one embodiment described herein. FIG. 2B provides a cut-away perspective detail view of the traveling wave launcher depicted in FIG. 2A and provides additional details showing the microstrip feed 220 and communicable coupling 119 between the microstrip feed and the slot-line signal converter 110, in accordance with at least one embodiment described herein.

As depicted in FIG. 2A, a number of vias 210 may conductively couple the slot-line signal converter 110 and/or the waveguide 150 to a ground plane within the semiconductor package 130. In some implementations, the vias 210 may extend about some or all of the perimeter of the slot-line signal converter 110. Although depicted as disposed within the semiconductor package 130, the conductive coupling between the slot-line signal converter 110 and/or the waveguide 150 and a ground plane may be performed using one or more conductors external to the semiconductor package 130. The traveling wave launcher system 200 as depicted in FIGS. 2A and 2B is advantageously compatible with standard printed circuit board manufacturing and assembly techniques. The tapered slot launcher 120 used with the traveling wave launcher system 200 is inherently wide band and is beneficially less sensitive to manufacturing tolerances than competitive technologies such as patch launchers or stacked patch launchers.

As depicted in FIG. 2B, a microstrip line signal propagates along a microstrip 220 to the connection point 119 coupling the microstrip 220 to the balun structure 118. The balun structure converts the microstrip line signal to a slot line mode signal that passes through the tapered slot launcher 120. Passage through the tapered slot launcher 120 converts the slot line mode signal to a closed waveguide mode signal that propagates along the axis of propagation 128.

Figure 3B:
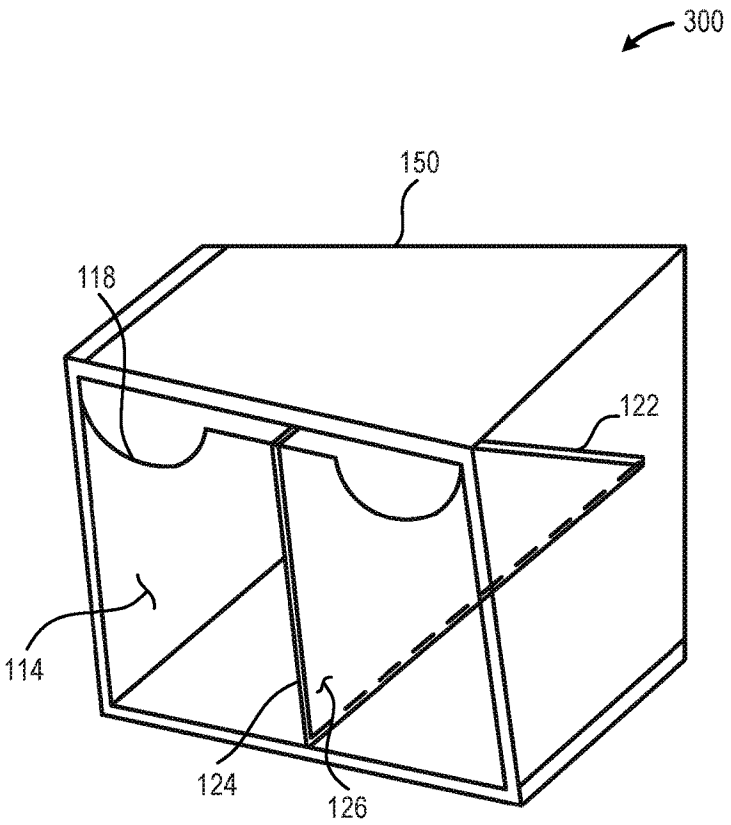
FIG. 3B provides a perspective view of an illustrative system that includes a second electrically conductive member and which depicts the physical geometry of the second electrically conductive member, the waveguide, and the tapered slot launcher, in accordance with at least one embodiment described herein.
Figure 3A:
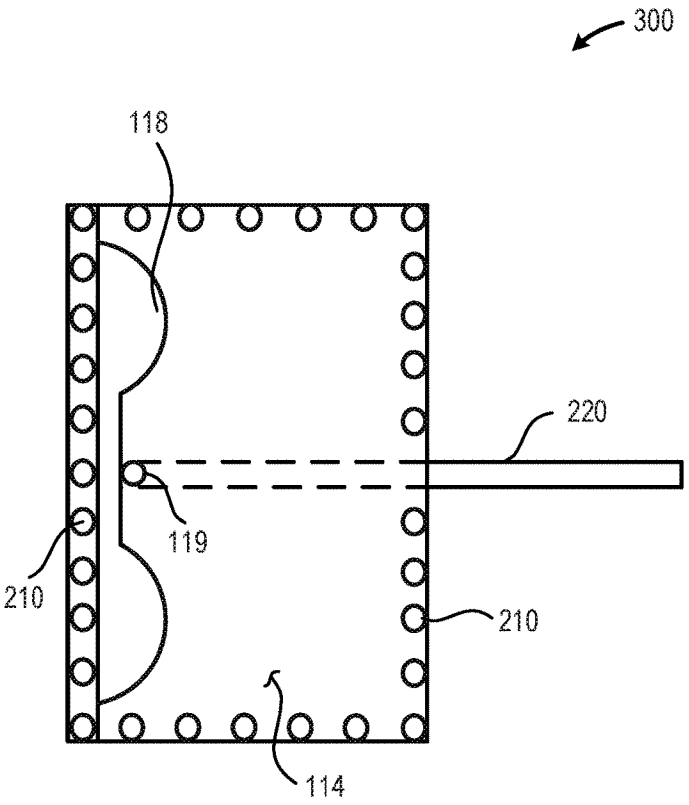
FIG. 3A provides a plan view of an illustrative system that includes a first electrically conductive member and which depicts the location of the connection point that conductively couples the microstrip line to the balun structure, in accordance with at least one embodiment described herein.

FIG. 3A provides a plan view of an illustrative system 300 that includes a first electrically conductive member 112 and which more clearly depicting the location of the connection point 119 that conductively couples the microstrip line 220 to the balun structure 118, in accordance with at least one embodiment described herein. As depicted in FIG. 3A, the slot-line signal converter 110 includes separate first electrically conductive member 112 and second electrically conductive member 114. The lower portion of the slot-line signal converter 110 (i.e., the first electrically conductive member 112) is depicted in FIG. 3A. As depicted in FIG. 3A, a number of conductors 210 may couple the first electrically conductive member 112 to an external grounding structure. In some implementations, the conductors 210 may include a number of vias conductively coupling the first electrically conductive member 112 to a ground plane in the semiconductor package 130. In some implementations, the conductors 210 may include a number of conductors conductively coupling the first electrically conductive member 112 to an external ground system. The conductors 210 may be disposed about all or a portion of the periphery of the first electrically conductive member 112.

FIG. 3B provides a perspective view of an illustrative system 300 that includes a second electrically conductive member 114 and which more clearly depicts the physical geometry of the second electrically conductive member 114, the waveguide 150, and the tapered slot launcher 120, in accordance with at least one embodiment described herein. As depicted in FIG. 3B, the second electrically conductive member 114 conductively couples to the waveguide 150 and the tapered slot launcher 120 extends into the interior space of the waveguide 150.

In embodiments, the second electrically conductive member 114 depicted in FIG. 3B is conductively coupled to the first electrically conductive member 112 depicted in FIG. 3A. In such embodiments, the balun structure 118 on the second electrically conductive member 114 may be aligned with the balun structure 118 on the first electrically conductive member 112 prior to conductively coupling the first electrically conductive member 112 to the second electrically conductive member 114. The conductive coupling of the first electrically conductive member 112 to the second electrically conductive member 114 may be achieved through any currently available or future developed systems or methods of conductively coupling two surfaces. Example, non-limiting, conductive coupling methods include soldering and attachment via one or more conductive adhesive materials.

Figure 4:
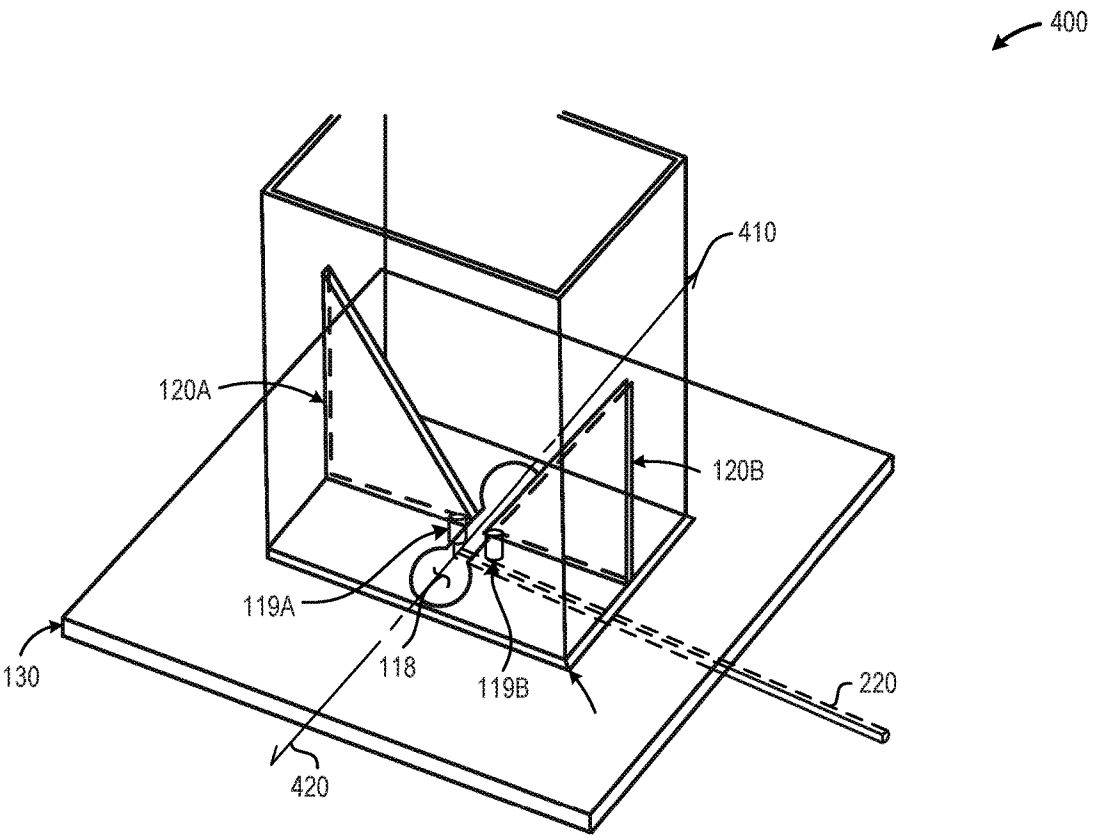
FIG. 4 provides a perspective view of an illustrative traveling wave launcher system 400 that includes two tapered slot launchers and disposed about a double-lobed balun structure in an open dielectric waveguide, in accordance with at least one embodiment described herein.

FIG. 4 provides a perspective view of an illustrative traveling wave launcher system 400 that includes two tapered slot launchers 120A and 120B disposed about a double-lobed balun structure 118 in an open dielectric waveguide 410, in accordance with at least one embodiment described herein. Mirrored tapered slot launchers 120 disposed 180° apart on opposite sides of the balun structure 118 may be used to excite an asymmetric closed waveguide or an open dielectric waveguide 410. Open dielectric waveguides 410 include open waveguides having any size, shape, cross-section, or configuration. For example, the open dielectric waveguide 410 may have a circular or oval cross section, in which case the two tapered slot launchers 120 and the balun structure 118 would remain the same and the slot-line signal converter 110 may be re-patterned to correspond to the perimeter of the open dielectric waveguide (i.e., in the above example, the slot-line signal converter 110 may be patterned onto the semiconductor package 130 as a circle or oval having a radius or major/minor axes corresponding to those of the open dielectric waveguide.

A microstrip transmission line 220 may communicably couple connection point 119A to one or more mm-wave emitting dies. The opposite side of the slot will need to be connected to the ground through the grounding via 119B. Where the balun structure 118 is a double-lobed open barbell configuration, the connection points 119A and 119*b* are disposed on opposite sides of the balun structure 118 at a location approximately in the middle of the open "bridge" portion connecting the two open lobes of the balun structure 118. In embodiments, one or more mm-wave emitting and/or receiving dies may be disposed in the semiconductor substrate 130. In other embodiments, the one or more mm-wave emitting and/or receiving dies may be disposed remote from the semiconductor substrate 130. The microstrip line is used to propagate the signals from the dies on the semiconductor package 130 to connection points 119A and 119B proximate the balun structure 118.

Figure 5:
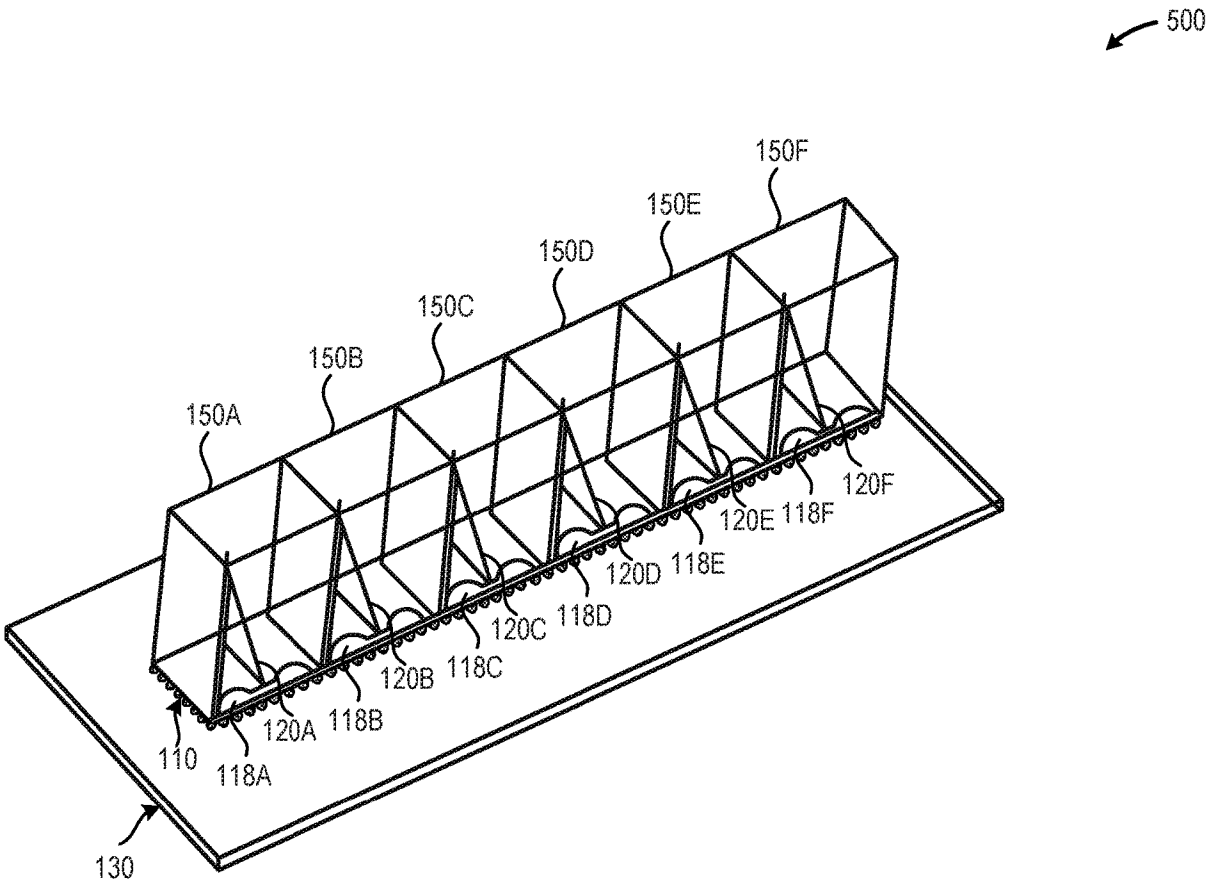
FIG. 5 provides a perspective view of an illustrative system that includes a plurality of traveling wave launcher systems coupled to a semiconductor package, each of the traveling wave launcher systems including: a slot-line signal converter; a balun structure; a tapered slot launcher; and an operably coupled waveguide, in accordance with at least one embodiment described herein.

FIG. 5 provides a perspective view of an illustrative system 500 that includes a plurality of traveling wave launcher systems 100A-100F (collectively "traveling wave launcher systems 100") coupled to a semiconductor package 130, each of the traveling wave launcher systems 100A-100F including: a respective slot-line signal converter 110A-110F; a respective balun structure 118A-118F; a respective tapered slot launcher 120A-120F (collectively, "tapered slot launchers 120"); and a respective waveguide 150A-150F (collectively, "waveguides 150"), in accordance with at least one embodiment described herein. The waveguide configuration depicted in FIG. 5 beneficially maximizes the number of individual waveguides 150 coupleable to a single semiconductor package 130. The one (row) by six (column) array of waveguides 150 and tapered slot launchers 120 may be expanded to include an array of waveguides 150 having any number of rows by any number of columns up to the physical space limitations provided by the underlying semiconductor package 130.

The arrangement depicted in FIG. 5 beneficially and advantageously permits the alignment of each tapered slot launcher 120 with a respective connection point and a respective waveguide 150, thereby reducing manufacturing costs while improving reliability and performance. Such an arrangement permits coupling one or more of the traveling wave launcher systems 100 to each of a number of mm-wave dies or similar microstrip signal producing devices and/or systems. Such a compact arrangement also beneficially facilitates the use of waveguides and microwave signals in tight or confined spaces such as those found in server racks.

Figure 6A:
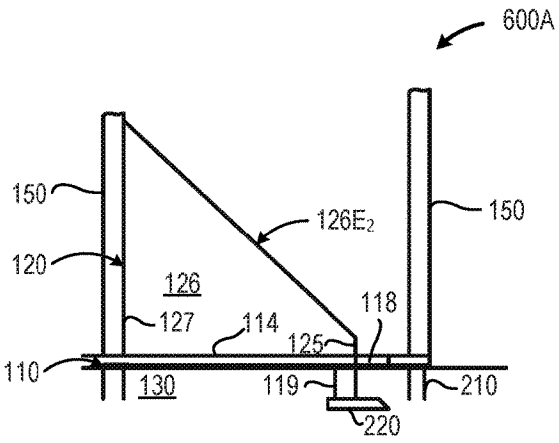
FIG. 6A provides a cross-sectional view of an illustrative traveling wave launcher system that includes a tapered slot launcher that includes first and second plates having a straight second edge extending from a first end to a second end of each plate forming the tapered slot launcher, in accordance with at least one embodiment described herein.

FIG. 6A provides a cross-sectional view of an illustrative traveling wave launcher system 600A that includes a tapered slot launcher 120 that includes first and second plates 124, 126 (only 126 visible in FIG. 6A) having a straight second edge 124$E_2$, 126$E_2$ extending from a first end 125 to a second end 127 of each plate, in accordance with at least one embodiment described herein. In some implementations, a straight edge tapered slot launcher 120 may be used based, at least in part, on the operating frequency and/or frequency ranges of the traveling wave signals propagated by the traveling wave launcher system 600A. The angle of the straight edge measured with respect to the second electrically conductive member 114 may range from about 5° to about 85°; from about 20° to about 70°; or from about 30° to about 60° and may be determined or otherwise selected based at least in part on the operating frequency and/or frequency band of the traveling wave launcher system 600A.

Figure 6B:
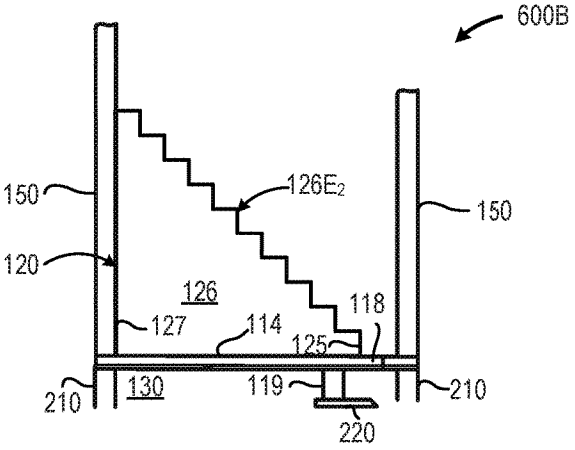
FIG. 6B provides a cross-sectional view of an illustrative traveling wave launcher system that includes a tapered slot launcher that includes first and second plates having a stepped second edge extending from a first end to a second end of each plate forming the tapered slot launcher, in accordance with at least one embodiment described herein.

FIG. 6B provides a cross-sectional view of an illustrative traveling wave launcher system 600B that includes a tapered slot launcher 120 that includes first and second plates 124, 126 (only 126 visible in FIG. 6B) having a stepped second edge 124$E_2$, 126$E_2$ extending from a first end 125 to a second end 127 of each plate, in accordance with at least one embodiment described herein. In some implementations, a stepped edge tapered slot launcher 120 may be used based, at least in part, on the operating frequency and/or frequency ranges of the traveling wave signals propagated by the traveling wave launcher system 600B. The pitch of the steps (e.g., the width and height of each step) may be the same or different and may be determined or otherwise selected based at least in part on the operating frequency and/or frequency band of the traveling wave launcher system 600B.

Figure 6C:
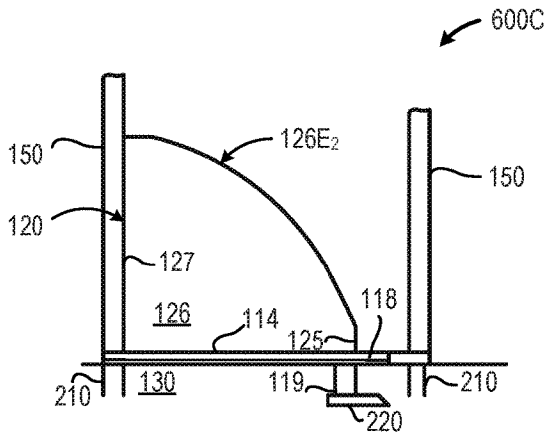
FIG. 6C provides a cross-sectional view of an illustrative traveling wave launcher system that includes a tapered slot launcher that includes first and second plates having a curved second edge extending from a first end to a second end of each plate forming the tapered slot launcher, in accordance with at least one embodiment described herein.

FIG. 6C provides a cross-sectional view of an illustrative traveling wave launcher system 600C that includes a tapered slot launcher 120 that includes first and second plates 124, 126 (only 126 visible in FIG. 6C) having a curved second edge 124$E_2$, 126$E_2$ extending from a first end 125 to a second end 127 of each plate, in accordance with at least one embodiment described herein. In some implementations, a curved edge tapered slot launcher 120 may be used based, at least in part, on the operating frequency and/or frequency ranges of the traveling wave signals propagated by the traveling wave launcher system 600C. The radius of curvature of the curved edge tapered slot launcher 120 may be increasing, decreasing, or constant and may be determined or otherwise selected based at least in part on the operating frequency and/or frequency band of the traveling wave launcher system 600C.

Figure 6D:
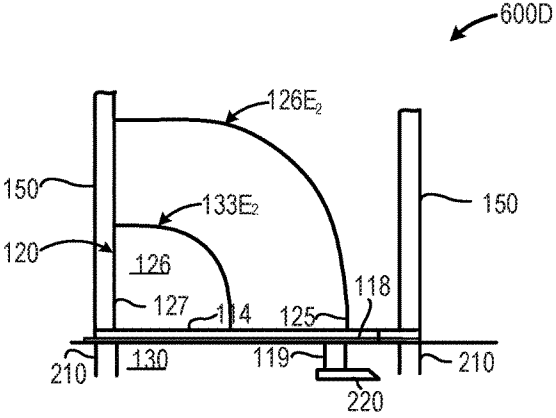
FIG. 6D provides a cross-sectional view of an illustrative traveling wave launcher system that includes a tapered slot launcher that includes first and second plates having a parabolic second edge extending from a first end to a second end of each plate forming the tapered slot launcher, in accordance with at least one embodiment described herein.

FIG. 6D provides a cross-sectional view of an illustrative traveling wave launcher system 600 that includes a tapered slot launcher 120 that includes first and second plates 124, 126 (only 126 visible in FIG. 6A) having a curved edge 124$E_2$, 126$E_2$ extending from a first end 125 to a second end 127 of each plate, in accordance with at least one embodiment described herein. An additional cut out 133E1 and 133E2 may be added which can help reduce the system weight and/or the material cost. In some implementations, a curved edge tapered slot launcher 120 may be used based, at least in part, on the operating frequency and/or frequency ranges of the traveling wave signals propagated by the traveling wave launcher system 600D. The curvature of the parabolic edge tapered slot launcher 120 may be determined or otherwise selected based at least in part on the operating frequency and/or frequency band of the traveling wave launcher system 600D.

Figure 7B:
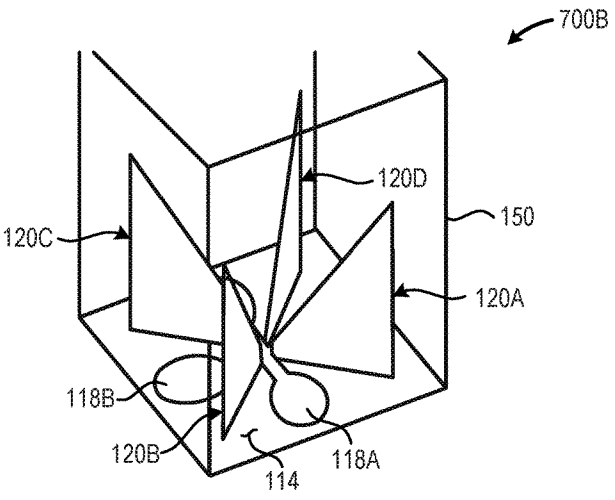
FIG. 7B provides a perspective view and a plan view of another illustrative traveling wave launcher system that includes multiple connection points and multiple tapered slot launchers to provide a traveling wave signal having a first polarization and a traveling wave signal having a second polarization, in accordance with at least one embodiment described herein.
Figure 7B:
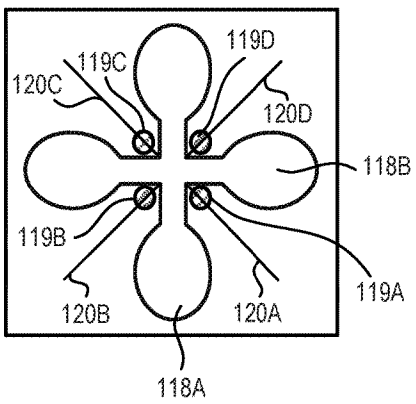
Figure 7A:
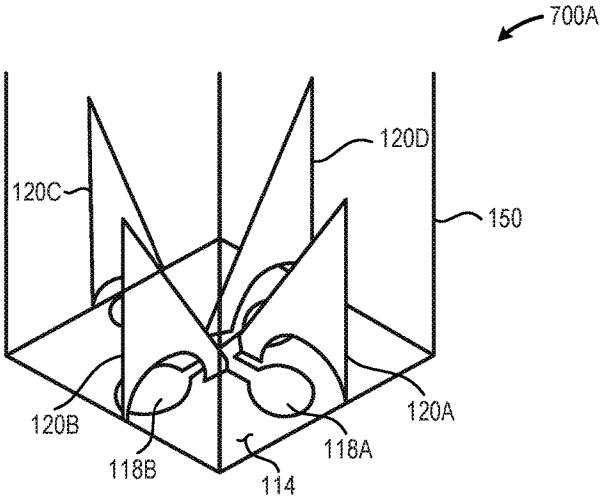
FIG. 7A provides a perspective view and a plan view of an illustrative traveling wave launcher system that includes a plurality connection points and a plurality of tapered slot launchers to provide a traveling wave signal having a first polarization and a traveling wave signal having a second polarization that is different than the first, in accordance with at least one embodiment described herein.
Figure 7A:
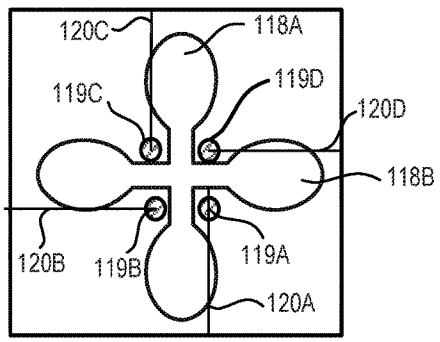

FIG. 7A provides a perspective view and a plan view of an illustrative traveling wave launcher system 700A that includes multiple connection points 119A-119D and multiple tapered slot launchers 120A-120D to provide a traveling wave signal having a first polarization and a traveling wave signal having a second polarization that is different than the first, in accordance with at least one embodiment described herein. The traveling wave launcher system 700A includes two intersecting double-lobed balun structures 118A and 118B. In some implementations, the double-lobed balun structures 118A and 118B may intersect at a 90° angle.

As depicted in FIG. 7A, connection points 119B and 119D may be disposed proximate and conductively coupled at least to tapered slot launchers 120B and 120D, respectively.

Similarly, connection points 119A and 119C may be disposed proximate and conductively coupled at least to tapered slot launchers 120A and 120C, respectively. In such an arrangement, connection points 119B and 119D may be used to feed a signal to the tapered slot launchers 120 to produce a traveling wave signal having a first polarization (e.g., horizontal polarization). In such an arrangement, connection points 119A and 119C may be used to feed the signal to the tapered slot launchers 120 to produce a traveling weave signal having a second polarization that may be different from the first polarization (e.g., vertical polarization).

FIG. 7B provides a perspective view and a plan view of an illustrative traveling wave launcher system 700B that includes multiple connection points 119A-119D and multiple tapered slot launchers 120A-120D to provide a traveling wave signal having a first (e.g., +45°) polarization and a traveling wave signal having a second (e.g., −45°) polarization, in accordance with at least one embodiment described herein. The traveling wave launcher system 700B includes two intersecting double-lobed balun structures 118A and 118B. In some implementations, the double-lobed balun structures 118A and 118B may intersect at a 90° angle.

As depicted in FIG. 7B, connection points 119B and 119D may be disposed proximate and conductively coupled at least to tapered slot launchers 120B and 120D, respectively. Similarly, connection points 119A and 119C may be disposed proximate and conductively coupled at least to tapered slot launchers 120A and 120C, respectively. In such an arrangement, connection points 119B and 119D may be used to feed a signal to the tapered slot launchers 120 to produce a traveling wave signal having a first polarization (e.g., +45° polarization). In such an arrangement, connection points 119A and 119C may be used to feed the signal to the tapered slot launchers 120 to produce a traveling weave signal having a second polarization that may be different from the first polarization (e.g., −45° polarization). Although polarizations of +45° and −45° are depicted in FIG. 7B, by repositioning the tapered slot launchers 120, traveling wave signals having other polarizations are possible.

Figure 8A:
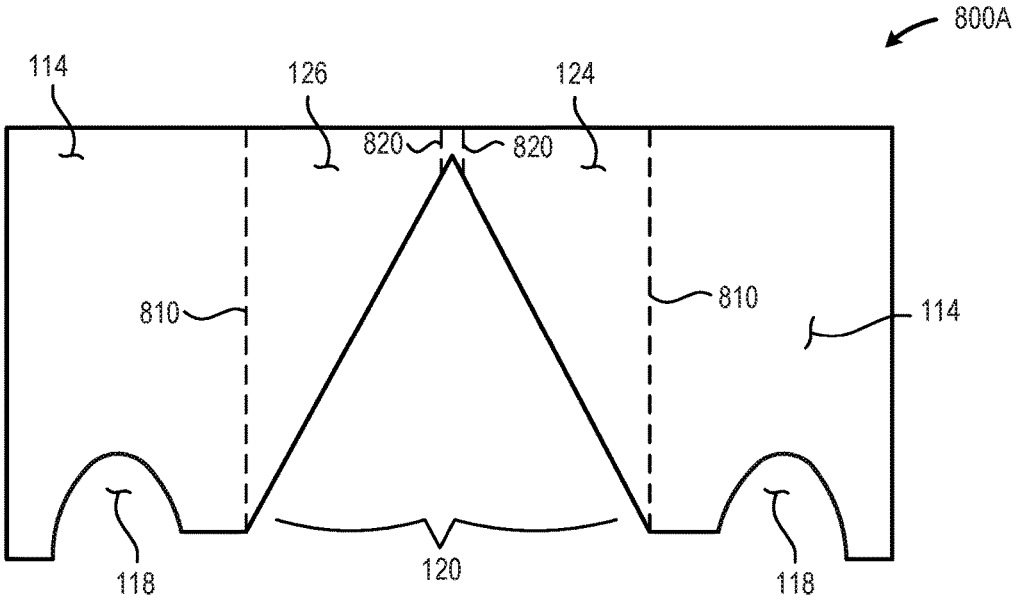
FIG. 8A provides a plan view of an illustrative deformable planar member that may be permanently deformed to provide the second electrically conductive member and the tapered slot launcher as depicted in FIG. 8B, in accordance with at least one embodiment described herein.
Figure 8B:
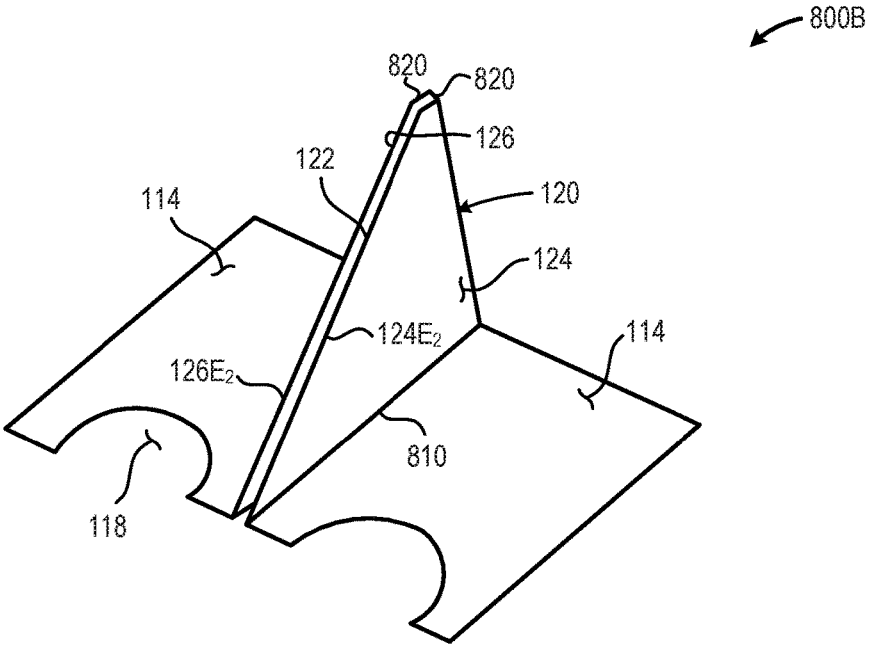
FIG. 8B provides a perspective view of a member that includes a second electrically conductive member and a tapered slot launcher formed by permanently deforming the deformable planar member depicted in FIG. 8A, in accordance with at least one embodiment described herein.

FIG. 8A provides a plan view of an illustrative deformable planar member 800A that may be permanently deformed to provide the second electrically conductive member 114 and the tapered slot launcher 120 as depicted in FIG. 8B, in accordance with at least one embodiment described herein. FIG. 8B provides a perspective view of a member 800B that includes a second electrically conductive member 114 and a tapered slot launcher 120 formed by permanently deforming the deformable planar member 800A depicted in FIG. 8A, in accordance with at least one embodiment described herein. As depicted in FIG. 8A, a deformable planar member 800A may be die cut or similarly removed from a sheet of conductive material, such as one or more metals or metal alloys, conductive polymers, etc. The deformable planar member 800A includes cutout sections to form the balun structure 118 and the second edges 124$E_2$ and 126$E_2$ of the tapered slot launcher 120. The deformable planar member 800A may include scores 810 and 820 or similar relieved areas that facilitate the formation of the permanently deformed member 800B depicted in FIG. 8B. The structure 800B depicted in FIG. 8B is a unitary structure that includes the second electrically conductive member 114 and an integrally formed tapered slot launcher 120.

Figure 9:
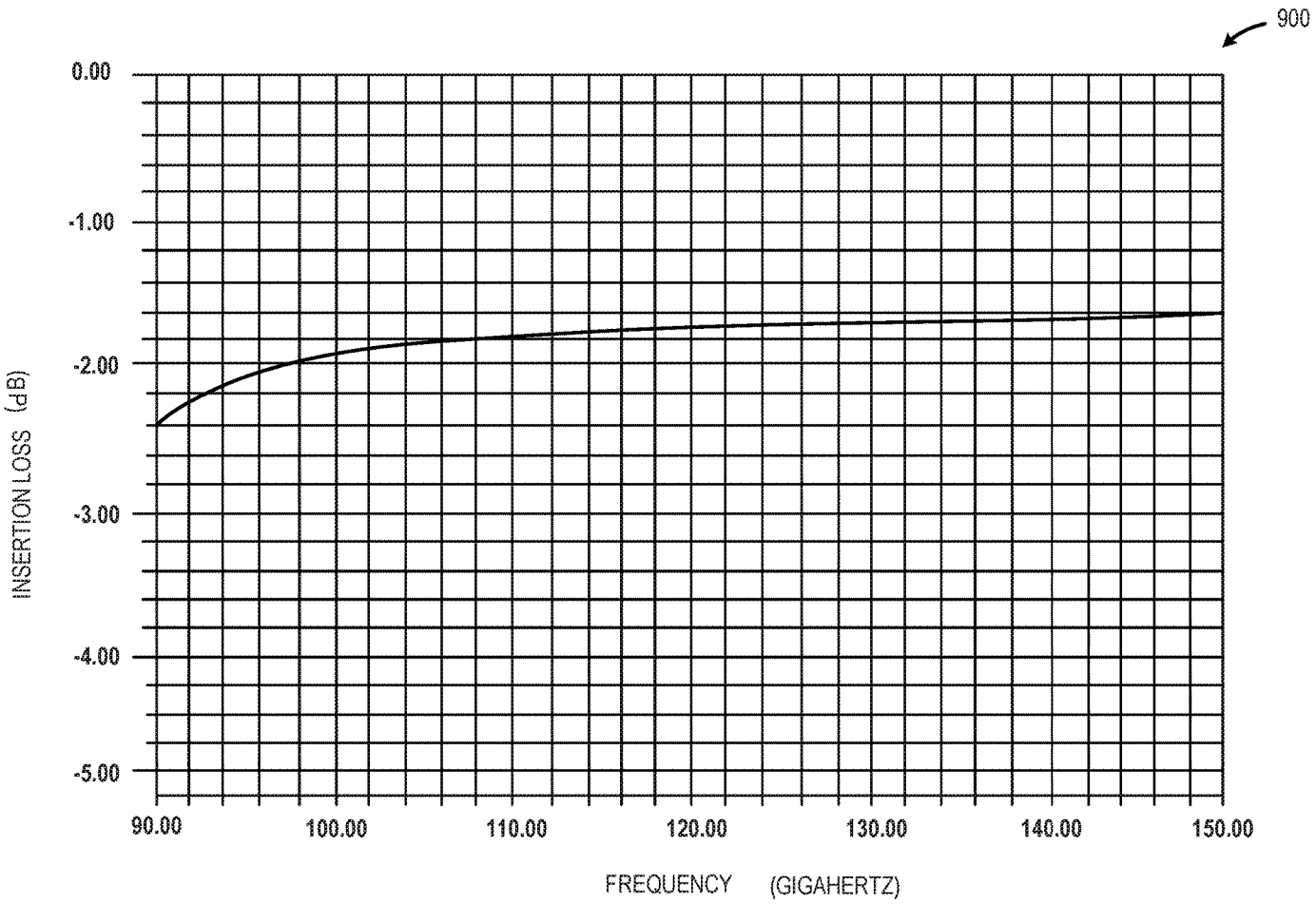
FIG. 9 provides a plot depicting the insertion loss (in dB) of a tapered slot launcher as a function of frequency (in GHz), in accordance with at least one embodiment described herein.

FIG. 9 provides a plot 900 depicting the insertion loss (in dB) of a tapered slot launcher 120 as a function of frequency (in GHz). As depicted in FIG. 9, the insertion loss attributable to the traveling wave launcher systems and methods described herein is approximately 2 dB across at least a portion of the microwave (mm-wave) spectrum.

Figure 10:
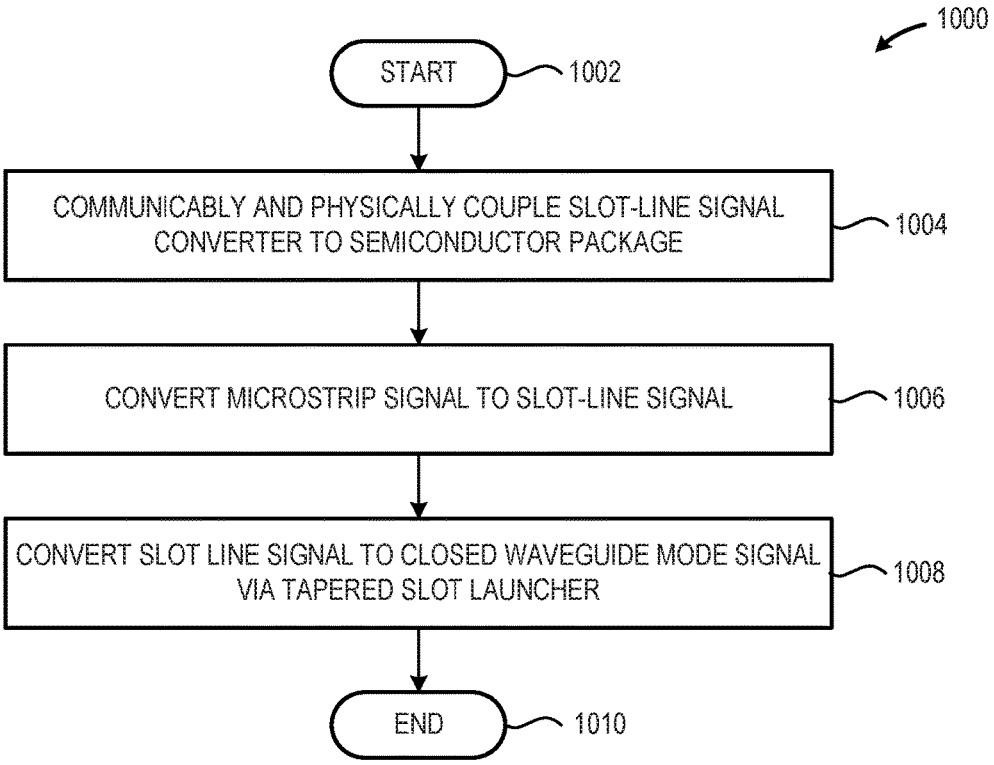
FIG. 10 provides a high-level logic flow diagram of an illustrative method for launching a traveling wave signal in a waveguide using a traveling wave launcher system, in accordance with at least one embodiment described herein.

FIG. 10 provides a high-level logic flow diagram of an illustrative method 1000 for launching a traveling wave signal in a waveguide 150 using a traveling wave launcher system, in accordance with at least one embodiment described herein. One or more devices or systems included in a semiconductor package 130 may generate a high frequency signal (e.g., a microwave frequency signal having a frequency between 30 GHz and 300 GHz) for transmission to one or more other semiconductor packages. The transmission of such signals may be performed wirelessly using either conductive or dielectric waveguides 150, 510. The method commences at 1002.

At 1004, a slot-line signal converter 110 is physically and communicably coupled to a semiconductor package 130. In some implementations, the slot-line signal converter 110 may include a first electrically conductive member 112 conductively coupled to a second electrically conductive member 114. A tapered slot launcher 120 communicably couples to the second electrically conductive member 114. At least a portion of the first electrically conductive member 112 and at least a portion of the second electrically conductive member 114 include a balun structure 118. In embodiments, the balun structure 118 includes a double-lobed or "barbell" shaped balun structure 118.

In some implementations, the first electrically conductive member 112 may be patterned on at least a portion of an exterior surface of the semiconductor package 130. In such implementations, the second electrically conductive member 114 may be physically and/or communicably coupled to a waveguide 150 and the second electrically conductive member 114 may be physically and/or conductively coupled to the first electrically conductive member 112.

In some implementations, the slot-line signal converter 110 may include a single conductive member in which all or a portion of the lower surface includes the first electrically conductive member 112 and all or a portion of the upper surface includes the second electrically conductive member 114. In such implementations, the first electrically conductive member 112 may physically and/or communicably couple to one or more contacts, lands, pads, or similar structures disposed in, on, or about all or a portion of the external surface of the semiconductor package 130.

At 1006, the signal transmitted to the traveling wave launcher system is converted from a microstrip signal to a slot line signal. In some implementations, the balun structure 118 in the slot-line signal converter 110 converts the microstrip signal to the slot line signal. In some implementations, the microstrip signal is introduced to at a connection point 119 near the geometric center of the balun structure 118.

At 1008, a tapered slot launcher 120 converts the slot line signal received from the balun structure to a closed waveguide mode signal. The tapered slot launcher 120 is physically and/or conductively coupled to the second electrically conductive member 114 and includes a first plate 124 and a second plate 126 spaced apart by a gap 122 that forms the "slot" portion of the tapered slot launcher 120. The physical geometry of the tapered slot launcher 120 may include first and second plates having: a straight second edge 124$E_2$, 126$E_2$ forming the slot 122; a stepped second edge 124$E_2$, 126$E_2$ forming the slot 122; a curved second edge 124$E_2$, 126$E_2$ forming the slot 122; or a parabolic second edge 124$E_2$, 126$E_2$ forming the slot 122. The method 1000 concludes at 1010.

Figure 11:
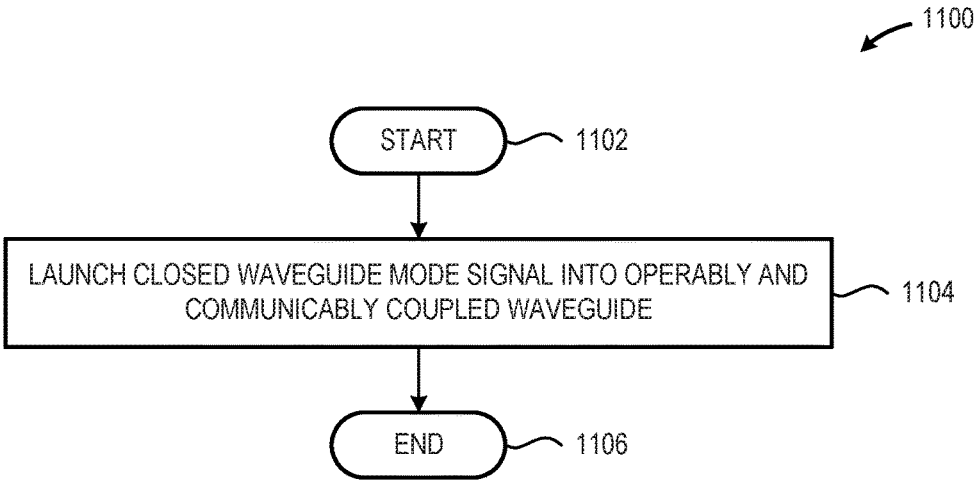
FIG. 11 provides a high-level flow diagram of a mm-wave signal transmission method useful with the method described in detail with regard to FIG. 10, in accordance with at least one embodiment described herein.

FIG. 11 provides a high-level flow diagram of a mm-wave signal transmission method 1100 useful with the method 1000 described in detail with regard to FIG. 10, in accordance with at least one embodiment described herein. The traveling wave signal produced by the tapered slot launcher 120 may be communicated to one or more external devices via the waveguide 150 communicably coupled to the second electrically conductive member 114 and/or to the tapered slot launcher 120. The method 1100 commences at 1102.

At 1104, the tapered slot launcher 120 launches the closed waveguide mode signal into a waveguide 150 physically and/or communicably coupled to the traveling wave launcher system. In some implementations, a single traveling wave signal having a single polarization may be launched into the waveguide 150. In some implementations, a plurality of traveling wave signals, each having a different polarization, may be launched into the waveguide 150 using a plurality of tapered slot launchers 120. The method 1100 concludes at 1106.

While FIGS. 10 and 11 illustrate operations according to different embodiments, it is to be understood that not all of the operations depicted in FIGS. 10 and 11 are necessary for other embodiments. Indeed, it is fully contemplated herein that in other embodiments of the present disclosure, the operations depicted in FIGS. 10 and 11, and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

Additionally, operations for the embodiments have been further described with reference to the above figures and accompanying examples. Some of the figures may include a logic flow. Although such figures presented herein may include a particular logic flow, it can be appreciated that the logic flow merely provides an example of how the general functionality described herein can be implemented. Further, the given logic flow does not necessarily have to be executed in the order presented unless otherwise indicated. In addition, the given logic flow may be implemented by a hardware element, a software element executed by a processor, or any combination thereof. The embodiments are not limited to this context.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. Thus, the breadth and scope of the present invention should not be limited by any of the above-described exemplary embodiments, but should be defined only in accordance with the following claims and their equivalents.

According to example 1, there is provided a traveling wave launcher apparatus. The apparatus may include a slot-line signal converter that includes: a first electrically conductive member having a first physical geometry, the first electrically conductive member conductively coupleable to a semiconductor package; and a second electrically conductive member having a second physical geometry; the second electrically conductive member conductively coupleable to the first electrically conductive member and conductively coupleable to a waveguide member. The apparatus may further include a tapered slot launcher that includes a first plate and a second plate; wherein the tapered slot launcher includes at least a first end and a second end, the first end of the tapered slot launcher physically closer to the second surface than the second end; wherein the tapered slot launcher communicably couples to the second electrically conductive member; and wherein the first plate and the second plate extend at an angle from the second electrically conductive member.

Example 2 may include elements of example 1 where the tapered slot launcher comprises at least one of: a solid member in which the first plate includes a first surface of the solid member and the second plate includes at least a portion of a second surface of the solid member, the second surface transversely opposed across a thickness of the solid member to the first surface; or the first plate includes at least a portion of a first member and the second plate includes at least a portion of a second member, the first member and the second member disposed in a parallel arrangement.

Example 3 may include elements of example 1 and may additionally include a second tapered slot launcher that includes a first plate and a second plate; wherein the second tapered slot launcher includes at least a first end and a second end, the first end of the second tapered slot launcher physically closer to the second surface than the second end; wherein the second tapered slot launcher communicably couples to the second electrically conductive member; and wherein the two plates forming the second tapered slot launcher extend at an angle from the second electrically conductive member.

Example 4 may include elements of example 3 where the tapered slot launcher and the second tapered slot launcher are radially separated by at least 90 degrees.

Example 5 may include elements of example 4 where the tapered slot launcher to generate a traveling wave having a first polarization; and the second tapered slot launcher to generate a traveling wave having a second polarization.

Example 6 may include elements of example 1 where the first electrically conductive member comprises an electrically conductive member patterned on the semiconductor package; and the second electrically conductive member comprises a second electrically conductive member physically and conductively coupled to the tapered slot launcher.

Example 7 may include elements of example 6 where at least a portion of the first electrically conductive member includes a first balun structure having a first physical geometry; and at least a portion of the second electrically conductive member includes a second balun structure having a second physical geometry.

Example 8 may include elements of example 7 where the first physical geometry comprises a double-lobed balun structure that includes at least one of: double circular lobes; double rectangular lobes; double wedge-shaped lobes; or double hexagonal lobes.

Example 9 may include elements of example 8 where the second physical geometry comprises a double-lobed balun structure that includes at least one of: double circular lobes; double rectangular lobes; double wedge-shaped lobes; or double hexagonal lobes.

Example 10 may include elements of example 6 where the second physical geometry corresponds to the first physical geometry.

Example 11 may include elements of example 1 where the second electrically conductive member comprises an electrically conductive member formed integral with the tapered slot launcher.

Example 12 may include elements of example 11 where the second electrically conductive member comprises a permanently deformable conductive member such that, in a deformed state, a portion of the second electrically conductive member forms at least a portion of the two plates forming the tapered slot launcher.

Example 13 may include elements of example 1 where the tapered slot formed by the two plates comprises at least one of: a straight-edge tapered slot, a stepped-edge tapered slot, a semi-elliptical tapered slot, an exponential tapered slot, or a quadratic tapered slot.

Example 14 may include elements of example 1 where the two plates forming the tapered slot launcher extend from the second electrically conductive member at an angle of approximately 90 degrees.

Example 15 may include elements of example 1 where the two plates forming the tapered slot launcher are parallel to each other.

According to example 16, there is provided a traveling wave transmission method. The method may include providing a signal to a slot-line signal converter communicably coupled to a semiconductor package and physically coupled to a surface of the semiconductor package; converting the signal to a slot line signal via the slot-line signal converter; and converting the slot line signal to a closed waveguide mode signal via a tapered slot launcher that includes a first plate and a second plate, the first plate and the second plate disposed normal to the surface of the semiconductor package.

Example 17 may include elements of example 16 where converting the slot line signal to a closed waveguide mode signal via a tapered slot launcher that includes a first plate and a second plate comprises at least one of: converting the slot line signal to a closed waveguide mode signal via a tapered slot launcher that includes a solid member in which the first plate includes a first surface of the solid member and the second plate includes at least a portion of a second surface of the solid member, the second surface transversely opposed across a thickness of the solid member to the first surface; or converting the slot line signal to a closed waveguide mode signal via a tapered slot launcher in which the first plate includes at least a portion of a first member and the second plate includes at least a portion of a second member, the first member and the second member disposed in a parallel arrangement.

Example 18 may include elements of example 16 and the method may additionally include launching the closed waveguide mode signal into a waveguide operably and communicably coupled to the tapered slot launcher.

Example 19 may include elements of example 18 and the method may additionally include generating the signal using a mm-wave die disposed in the semiconductor package.

Example 20 may include elements of example 20 where providing a signal to a slot-line signal converter communicably coupled to a semiconductor package and physically coupled to a surface of the semiconductor package may include: physically and conductively coupling a first electrically conductive member of slot-line signal converter to at least a portion of the surface of the semiconductor package; and where converting the slot line signal to a closed waveguide mode signal via a tapered slot launcher may include: converting the slot line signal to a closed waveguide mode signal via a tapered slot launcher physically and communicably coupled to a second electrically conductive member of the slot-line signal converter, the second electrically conductive member physically and communicably coupled to the first electrically conductive member.

Example 21 may include elements of example 18 where disposing a first electrically conductive member of the slot-line signal converter proximate at least a portion of the surface of the semiconductor package may include: physically and conductively coupling the first electrically conductive member proximate at least a portion of the surface of the semiconductor package, the first electrically conductive member including a balun structure having a first physical geometry; and converting the slot line signal to a closed waveguide mode signal via a tapered slot launcher physically and communicably coupled to a second electrically conductive member of the slot-line signal converter may include: converting the slot line signal to a closed waveguide mode signal via the tapered slot launcher physically and communicably coupled to the second electrically conductive member, the second electrically conductive member including a second balun structure having a second physical geometry.

Example 22 may include elements of example 21 where converting the slot line signal to a closed waveguide mode signal via the tapered slot launcher physically and communicably coupled to the second electrically conductive member, the second electrically conductive member including a second balun structure having a second physical geometry may include:

converting the slot line signal to a closed waveguide mode signal via a tapered slot launcher physically and communicably coupled to the second electrically conductive member of the slot-line signal converter, the second electrically conductive member including the second balun structure having the second physical geometry, wherein the second physical geometry of the second balun structure corresponds to the first physical geometry of the first balun structure.

Example 23 may include elements of example 21 where disposing a first electrically conductive member of the slot-line signal converter proximate at least a portion of the surface of the semiconductor package, the first electrically conductive member including a balun structure having a first physical geometry may include: disposing a first surface of the slot-line signal converter proximate at least a portion of the surface of the semiconductor package, the first surface of the slot-line signal converter including a balun structure having a first physical geometry that includes a double-lobed first balun structure that includes at least one of: double circular lobes; double rectangular lobes; double wedge-shaped lobes; or double hexagonal lobes.

Example 24 may include elements of example 21 where converting the slot line signal to a closed waveguide mode signal via a tapered slot launcher physically and communicably coupled to a second electrically conductive member of the slot-line signal converter, the second electrically conductive member including a second balun structure having a second physical geometry may include converting the slot line signal to a closed waveguide mode signal via a tapered slot launcher physically and communicably coupled to the second electrically conductive member of the slot-line signal converter, the second electrically conductive member including a second balun structure having a second physical geometry includes at least one of: double circular lobes; double rectangular lobes; double wedge-shaped lobes; or double hexagonal lobes.

Example 25 may include elements of example 16 where converting the slot line signal to a closed waveguide mode signal via a tapered slot launcher that includes two plates spaced apart to form a tapered slot may include converting the slot line signal to a closed waveguide mode signal via a tapered slot launcher that includes two plates spaced apart to form a tapered slot, the tapered slot comprising: a straight-edge tapered slot, a stepped-edge tapered slot, a semi-elliptical tapered slot, an exponential tapered slot, or a quadratic tapered slot.

According to example 26, there is provided a traveling wave transmission system. The system may include a means for providing a signal to a slot-line signal converter communicably coupled to a semiconductor package and physically coupled to a surface of the semiconductor package; a means for converting the signal to a slot line signal, via the slot-line signal converter; and a means for converting the slot line signal to a closed waveguide mode signal via a tapered slot launcher that includes a first plate and a second plate, the first plate and the second plate disposed normal to the surface of the semiconductor package.

Example 27 may include elements of example 26 and the system may additionally include a means for launching the closed waveguide mode signal into a waveguide operably and communicably coupled to the tapered slot launcher.

Example 28 may include elements of example 27 and the system may additionally include a means for generating the signal using a mm-wave die disposed in the semiconductor package.

Example 29 may include elements of example 27 where the means for providing a signal to a slot-line signal converter communicably coupled to a semiconductor package and physically coupled to a surface of the semiconductor package may include: a means for disposing a first electrically conductive member of the slot-line signal converter proximate at least a portion of the surface of the semiconductor package; and the means for converting the slot line signal to a closed waveguide mode signal via a tapered slot launcher that includes two plates spaced apart to form a tapered slot, the two plates disposed normal to the surface of the semiconductor package may include: a means for converting the slot line signal to a closed waveguide mode signal via a tapered slot launcher physically and communicably coupled to a second electrically conductive member of the slot-line signal converter, the second electrically conductive member physically and communicably coupled to the first electrically conductive member.

Example 30 may include elements of example 29 where the means for disposing a first electrically conductive member of the slot-line signal converter proximate at least a portion of the surface of the semiconductor package may include: a means for disposing the first electrically conductive member of the slot-line signal converter proximate at least a portion of the surface of the semiconductor package, the first electrically conductive member including a balun structure having a first physical geometry; and the means for converting the slot line signal to a closed waveguide mode signal via a tapered slot launcher physically and communicably coupled to a second electrically conductive member of the slot-line signal converter may include a means for converting the slot line signal to a closed waveguide mode signal via a tapered slot launcher physically and communicably coupled to the second electrically conductive member of the slot-line signal converter, the second electrically conductive member including a second balun structure having a second physical geometry.

Example 31 may include elements of example 30 where the means for converting the slot line signal to a closed waveguide mode signal via a tapered slot launcher physically and communicably coupled to a second electrically conductive member of the slot-line signal converter, the second electrically conductive member including a second balun structure having a second physical geometry may include a means for converting the slot line signal to a closed waveguide mode signal via a tapered slot launcher physically and communicably coupled to the second electrically conductive member of the slot-line signal converter, the second electrically conductive member including a second balun structure having a second physical geometry, wherein the second physical geometry corresponds to the first physical geometry.

Example 32 may include elements of example 30 where the means for disposing a first electrically conductive member of the slot-line signal converter proximate at least a portion of the surface of the semiconductor package, the first electrically conductive member including a balun structure having a first physical geometry may include a means for disposing the first electrically conductive member of the slot-line signal converter proximate at least a portion of the surface of the semiconductor package, the first electrically conductive member including a balun structure having a first physical geometry comprises a double-lobed first balun structure that includes at least one of: double circular lobes; double rectangular lobes; double wedge-shaped lobes; or double hexagonal lobes.

Example 33 may include elements of example 30 where the means for converting the slot line signal to a closed waveguide mode signal via a tapered slot launcher physically and communicably coupled to a second electrically conductive member of the slot-line signal converter, the second electrically conductive member including a second balun structure having a second physical geometry may include a means for converting the slot line signal to a closed waveguide mode signal via a tapered slot launcher physically and communicably coupled to the second electrically conductive member of the slot-line signal converter, the second electrically conductive member including a second balun structure having a second physical geometry that includes at least one of: double circular lobes; double rectangular lobes; double wedge-shaped lobes; or double hexagonal lobes.

Example 34 may include elements of example 25 where the means for converting the slot line signal to a closed waveguide mode signal via a tapered slot launcher that includes two plates spaced apart to form a tapered slot may include: a means for converting the slot line signal to a closed waveguide mode signal via a tapered slot launcher that includes two plates spaced apart to form a tapered slot, the tapered slot comprising: a straight-edge tapered slot, a stepped-edge tapered slot, a semi-elliptical tapered slot, an exponential tapered slot, or a quadratic tapered slot.

According to example 35, there is provided a mm-Wave transmission system. The system may include a semiconductor package. The semiconductor package may include a mm-wave die; and a first electrically conductive member having a first physical geometry, the first electrically conductive member disposed on at least a portion of an exposed surface of the semiconductor package and conductively coupled to the mm-wave die; a waveguide defining an interior space; and a traveling wave microwave launcher communicably coupling the semiconductor package and the waveguide member. The traveling wave microwave launcher may include a slot-line signal converter that includes: a second electrically conductive member having a first surface, a second surface, and a second physical geometry; the first surface conductively coupleable to the first electrically conductive member and the second surface conductively coupleable to the waveguide; and a tapered slot launcher that includes a first plate and a second plate, the tapered slot launcher at least partially extending into the interior space of the waveguide; wherein the tapered slot launcher includes at least a first end and a second end, the first end of the tapered slot launcher physically closer to the second surface than the second end; wherein the tapered slot launcher communicably couples to the second electrically conductive member; and wherein the first plate and the second plate extend at an angle from the second electrically conductive member.

Example 36 may include elements of example 35 where the first physical geometry includes a double-lobed balun structure; and the second physical geometry includes a double-lobed balun structure.

Example 37 may include elements of example 36 where the first physical geometry comprises a double-lobed balun structure that includes at least one of: double circular lobes; double rectangular lobes; double wedge-shaped lobes; or double hexagonal lobes.

Example 38 may include elements of example 37 where the second physical geometry comprises a double-lobed balun structure that includes at least one of: double circular lobes; double rectangular lobes; double wedge-shaped lobes; or double hexagonal lobes.

Example 39 may include elements of example 36 where the second physical geometry corresponds to the first physical geometry.

Example 40 may include elements of example 35 where the second electrically conductive member is conductively affixed to the first electrically conductive member.

Example 41 may include elements of example 40 where the second electrically conductive member is conductively affixed to the first electrically conductive member via a solder connection or via a conductive adhesive.

Example 42 may include elements of any of examples 35 through 41 and the system may additionally include a second tapered slot launcher that includes a first plate and a second plate; wherein the second tapered slot launcher includes at least a first end and a second end, the first end of the second tapered slot launcher physically closer to the second surface than the second end; wherein the second tapered slot launcher communicably couples to the second electrically conductive surface; and wherein the first plate and the second plate extend at an angle from the second electrically conductive surface.

Example 43 may include elements of example 42 where the tapered slot launcher and the second tapered slot launcher are radially separated by at least 90 degrees.

Example 44 may include elements of example 43 where the tapered slot launcher to generate a traveling wave having a first polarization; and the second tapered slot launcher to generate a traveling wave having a second polarization.

Example 45 may include elements of example 42 where the second electrically conductive member is formed integral with the tapered slot launcher.

Example 46 may include elements of example 45 where the second electrically conductive member comprises a permanently deformable member such that a portion of the second electrically conductive member provides the two parallel plates forming the tapered slot launcher.

Example 47 may include elements of example 42 where the first plate and the second plate form a second tapered slot launcher that includes at least one of: a straight-edge tapered slot launcher, a stepped-edge tapered slot launcher, a semi-elliptical tapered slot launcher, an exponential tapered slot launcher, or a quadratic tapered slot launcher.

Example 48 may include elements of example 40 where the first plate and the second plate extend from the second electrically conductive member at an angle of approximately 90 degrees.

Example 49 may include elements of example 40 where the first plate and the second plate are parallel to each other.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

What is claimed:

1. A traveling wave launcher apparatus, comprising:

a slot-line signal converter that includes:

a first electrically conductive member having a first physical geometry, the first electrically conductive member conductively coupleable to a semiconductor package; and a second electrically conductive member having a second physical geometry; the second electrically conductive member conductively coupleable to the first electrically conductive member and conductively coupleable to a waveguide member; and a tapered slot launcher that includes a first plate and a second plate;

wherein the tapered slot launcher includes at least a first end and a second end, the first end of the tapered slot launcher physically closer to a surface of the second electrically conductive member than the second end of the tapered slot launcher;

wherein the tapered slot launcher communicably couples to the second electrically conductive member; and wherein the first plate and the second plate extend at an angle from the second electrically conductive member.

2. The apparatus of claim 1 wherein the tapered slot launcher comprises at least one of:

a solid member in which the first plate includes a first surface of the solid member and the second plate includes at least a portion of a second surface of the solid member, the second surface transversely opposed across a thickness of the solid member to the first surface; or the first plate includes at least a portion of a first member and the second plate includes at least a portion of a second member, the first member and the second member disposed in a parallel arrangement.

3. The apparatus of claim 1, further comprising a second tapered slot launcher that includes a first plate and a second plate;

wherein the second tapered slot launcher includes at least a first end and a second end, the first end of the second tapered slot launcher physically closer to the surface of the second conductive member than the second end the second tapered slot launcher;

wherein the second tapered slot launcher communicably couples to the second electrically conductive member; and wherein the first plate and the second plate forming the second tapered slot launcher extend at an angle from the second electrically conductive member.

4. The apparatus of claim 3 wherein the tapered slot launcher and the second tapered slot launcher are radially separated by at least 90 degrees from each other.

5. The apparatus of claim 4 wherein:

the tapered slot launcher to generate a traveling wave having a first polarization; and the second tapered slot launcher to generate a traveling wave having a second polarization.

6. The apparatus of claim 1 wherein: the first electrically conductive member is patterned on the semiconductor package; and the second electrically conductive member is physically and conductively coupled to the tapered slot launcher.

7. The apparatus of claim 6 wherein:

at least a portion of the first electrically conductive member comprises a first balun structure; and at least a portion of the second electrically conductive member comprises a second balun structure.

8. The apparatus of claim 7 wherein the first balun structure comprises a double-lobed balun structure that includes at least one of: double circular lobes; double rectangular lobes; double wedge-shaped lobes; or double hexagonal lobes.

9. The apparatus of claim 8 wherein the second balun structure comprises a double-lobed balun structure that includes at least one of: double circular lobes; double rectangular lobes; double wedge-shaped lobes; or double hexagonal lobes.

10. The apparatus of claim 7 wherein the second balun structure corresponds to the first balun structure.

11. The apparatus of claim 1 wherein the second electrically conductive member is formed integral with the tapered slot launcher.

12. The apparatus of claim 11 wherein the second electrically conductive member comprises a permanently deformable conductive member such that, in a deformed state, a portion of the second electrically conductive member forms at least a portion of the two plates forming the tapered slot launcher.

13. The apparatus of claim 1 wherein the tapered slot launcher formed by the first plate and the second plate comprises at least one of: a straight-edge tapered slot launcher, a stepped-edge tapered slot launcher, a semi-elliptical tapered slot launcher, an exponential tapered slot launcher, or a quadratic tapered slot launcher.

14. The apparatus of claim 1 wherein the first plate and the second plate extend from the second electrically conductive member at an angle of approximately 90 degrees from each other.

15. The apparatus of claim 14 wherein the first plate and the second plate are parallel to each other.

16. A traveling wave transmission method, comprising:

providing a signal to a slot-line signal converter communicably coupled to a semiconductor package and physically coupled to a surface of the semiconductor package;

converting the signal to a slot line signal via the slot-line signal converter; and converting the slot line signal to a closed waveguide mode signal via a tapered slot launcher that includes a first plate and a second plate, the first plate and the second plate disposed normal to the surface of the semiconductor package.

17. The method of claim 16 wherein converting the slot line signal to the closed waveguide mode signal via the tapered slot launcher that includes the first plate and the second plate comprises at least one of:

converting the slot line signal to the closed waveguide mode signal via the tapered slot launcher that includes a solid member in which the first plate includes a first surface of the solid member and the second plate includes at least a portion of a second surface of the solid member, the second surface transversely opposed across a thickness of the solid member to the first surface; or converting the slot line signal to the closed waveguide mode signal via the tapered slot launcher in which the first plate includes at least a portion of a first member and the second plate includes at least a portion of a second member, the first member and the second member disposed in a parallel arrangement.

18. The method of claim 16 wherein:

providing the signal to the slot-line signal converter communicably coupled to a semiconductor package and physically coupled to the surface of the semiconductor package comprises:

physically and conductively coupling a first electrically conductive member of slot-line signal converter to at least a portion of the surface of the semiconductor package; and converting the slot line signal to the closed waveguide mode signal via the tapered slot launcher that includes a first plate and a second plate comprises:

converting the slot line signal to the closed waveguide mode signal via the tapered slot launcher physically and communicably coupled to a second electrically conductive member of the slot-line signal converter, the second electrically conductive member physically and communicably coupled to the first electrically conductive member.

19. The method of claim 18 wherein:

disposing the first electrically conductive member of the slot-line signal converter proximate at least a portion of the surface of the semiconductor package comprises:

physically and conductively coupling the first electrically conductive member proximate at least a portion of the surface of the semiconductor package, the first electrically conductive member including a first balun structure; and converting the slot line signal to the closed waveguide mode signal via the tapered slot launcher physically and communicably coupled to the second electrically conductive member of the slot-line signal converter comprises:

converting the slot line signal to the closed waveguide mode signal via the tapered slot launcher physically and communicably coupled to the second electrically conductive member, the second electrically conductive member including a second balun structure.

20. The method of claim 19 wherein converting the slot line signal to the closed waveguide mode signal via the tapered slot launcher physically and communicably coupled to the second electrically conductive member, the second electrically conductive member including the second balun structure comprises:

converting the slot line signal to the closed waveguide mode signal via the tapered slot launcher physically and communicably coupled to the second electrically conductive member of the slot-line signal converter, the second electrically conductive member including the second balun structure that corresponds physically to the first balun structure.

21. The method of claim 19 wherein disposing the first electrically conductive member of the slot-line signal converter proximate at least a portion of the surface of the semiconductor package, the first electrically conductive member including the first balun structure comprises:

disposing a first surface of the slot-line signal converter proximate at least a portion of the surface of the semiconductor package, the first surface of the slot-line signal converter including the first balun structure that includes a double-lobed first balun structure that includes at least one of: double circular lobes; double rectangular lobes; double wedge-shaped lobes; or double hexagonal lobes.

22. The method of claim 19 wherein converting the slot line signal to the closed waveguide mode signal via the tapered slot launcher physically and communicably coupled to the second electrically conductive member of the slot-line signal converter, the second electrically conductive member including the second balun structure comprises:

converting the slot line signal to the closed waveguide mode signal via the tapered slot launcher physically and communicably coupled to the second electrically conductive member of the slot-line signal converter, the second electrically conductive member including the second balun structure that includes at least one of:

double circular lobes; double rectangular lobes; double wedge-shaped lobes; or double hexagonal lobes.

23. The method of claim 16 wherein converting the slot line signal to the closed waveguide mode signal via the tapered slot launcher that includes the first plate and the second plate comprises:

converting the slot line signal to the closed waveguide mode signal via the tapered slot launcher that includes the first plate and the second plate, the tapered slot launcher comprising: a straight-edge tapered slot launcher, a stepped-edge tapered slot launcher, a semi-elliptical tapered slot launcher, an exponential tapered slot launcher, or a quadratic tapered slot launcher.

24. A traveling wave transmission system, comprising:

a means for providing a signal to a slot-line signal converter communicably coupled to a semiconductor package and physically coupled to a surface of the semiconductor package;

a means for converting the signal to a slot line signal, via the slot-line signal converter; and a means for converting the slot line signal to a closed waveguide mode signal via a tapered slot launcher that includes a first plate and a second plate, the first plate and the second plate disposed normal to the surface of the semiconductor package.

25. The system of claim 24 wherein:

the means for providing the signal to the slot-line signal converter communicably coupled to the semiconductor package and physically coupled to the surface of the semiconductor package comprises:

a means for disposing a first electrically conductive member of the slot-line signal converter proximate at least a portion of the surface of the semiconductor package; and the means for converting the slot line signal to the closed waveguide mode signal via the tapered slot launcher that includes a first plate and a second plate disposed normal to the surface of the semiconductor package comprises:

a means for converting the slot line signal to the closed waveguide mode signal via the tapered slot launcher physically and communicably coupled to a second electrically conductive member of the slot-line signal converter, the second electrically conductive member physically and communicably coupled to the first electrically conductive member.

* * * * *